United States Patent [19]

Kageyama et al.

[11] 4,434,063

[45] Feb. 28, 1984

[54] LUBRICANT COMPOSITIONS

[75] Inventors: Hachiro Kageyama, Kamakura; Tsutomu Moriuchi, Chigasaki; Yoshiaki Oikawa, Fujisawa, all of Japan

[73] Assignee: Kyodo Yushi Co., Ltd., Tokyo, Japan

[21] Appl. No.: 291,059

[22] Filed: Aug. 7, 1981

[51] Int. Cl.[3] ..... C10L 1/54

[52] U.S. Cl. ..... 252/25; 252/62.63

[58] Field of Search ..... 252/25, 62.63; 423/594

[56] References Cited

U.S. PATENT DOCUMENTS

| | | | |
|---|---|---|---|
| 3,115,469 | 12/1963 | Hamilton | 252/25 |
| 3,519,386 | 7/1970 | Fedock et al. | 423/594 |
| 3,904,421 | 9/1975 | Shimizu et al. | 423/594 |

*Primary Examiner*—Jacqueline V. Howard

*Attorney, Agent, or Firm*—Young & Thompson

[57] ABSTRACT

A novel lubricant composition is disclosed, which contains not less than 0.1% by weight of at least one calcium ferrite having the following general formula:

$$Ca_xFe_yO_{x+(3/2)y}$$

wherein x is 1 or 2 and y is 2 or 4, provided that y is 2 or 4 when x is 1, and y is 2 when x is 2. The calcium ferrites may be monocalcium ferrite, dicalcium ferrite or hemicalcium ferrite, produced by mixing iron oxide and a calcium compound in a molar ratio of 1:0.5 to 1:2 and fusing them by heating at a temperature of 1200°–1400° C. The resultant material contains not more than 5% by weight of the whole, of ferric oxide, silica and alumina as impurities. The calcium ferrites have a maximum particle size of 100μ, preferably 0.15μ. They can be used as such for lubricant purposes, or can be incorporated in a lubricating oil or grease, such as a mineral oil, in an amount more than 0.1% by weight and preferably more than 1% by weight.

6 Claims, No Drawings

LUBRICANT COMPOSITIONS

BACKGROUND OF THE INVENTION

1. Field of the Invention

This invention relates to novel lubricant compositions.

2. Description of the Prior Art

Heretofore, various lubricants have widely been used for the prevention or reduction of friction or wear in bearings of machines and the like. Lately, the use of lubricants is of particular interest in view of resource-saving and energy-saving.

These lubricants are classified into a lubricating oil, a grease, a solid lubricant and others in view of their forms. Since there are many fields of application, lubricants are used under various conditions which range from moderate conditions of low load, low speed and the like to very severe conditions of high load, impact load, high speed and the like. Into lubricants are usually compounded various additives so as to be usable under various conditions as described above.

The proper selection of lubricants is an important factor in the lubricating art, which greatly influences the smooth operation and life of machines.

In the development of excellent lubricants, it is ideal to develop all-purpose lubricants. However, since lubricants are used under the various conditions mentioned above, it is impossible to apply a single lubricant to all purposes, so that it is presently attempted to extend the fields of application of a single lubricant as far as possible. In order to develop or produce a lubricant suitable for certain purposes, it is important to precisely grasp the states and conditions encountered to select a lubricant form and additives adaptable therefor. The lubricant form is relatively easily determined because the selection thereof is frequently restricted by the mechanisms and circumstances of the lubricating areas of the machines and installations involved. On the other hand, the selection of proper additives is not easily determined because the additives are numerous and it is difficult to predict how additives act on the lubricating area of the machines and installations involved. Therefore, proper additives are generally selected by a simulation test for the lubricating areas involved. In general, additives for lubricants are classified into an oiliness agent, an extreme pressure agent, an antiwear agent, an antioxidant, a rust inhibitor, a corrosion inhibitor, a dispersant, a pour point depressant, a viscosity index improver, an emulsifier, a defoamer, an antifungal agent and the like. A great number of additives have been developed and used in the form of liquids and solids. Among them, certain additives may possess two-purpose function as a combination of extreme pressure agent and antioxidant, pour point depressant and viscosity index improver, emulsifier and rust inhibitor, or the like. Furthermore, some extreme pressure agents, antiwear agents and the like are added as a dispersion because they are insoluble in a lubricating oil or the like.

SUMMARY OF THE INVENTION

The invention provides a lubricant composition composed of a novel solid lubricant, containing not less than 0.1% by weight of at least one calcium ferrite having the following general formula:

$$Ca_xFe_yO_{x+(3/2)y} \quad (1)$$

wherein x is 1 or 2 and y is 2 or 4, provided that y is 2 or 4 when x is 1 and y is 2 when x is 2.

Thus, according to the invention, at least one calcium ferrite given by the formula (1) is produced and used as a solid lubricant as it is or dispersed into a lubricating oil, grease, resin or the like in an amount of not less than 0.1% by weight, so that the lubricant composition according to the invention is high in utility.

DETAILED DESCRIPTION OF THE INVENTION

As the solid lubricant to be used for the same purpose as in the lubricant composition according to the invention, there are usually mentioned molybdenum disulfide, graphite, polytetrafluoroethylene (PTFE) and the like. Besides, calcium fluoride, pyrophosphates, sulfides of various metals, polyimides and the like have been developed as solid lubricants.

Molybdenum disulfide is largely used as a solid lubricant as well as graphite owing to the excellent lubricity. However, when this substance is used in air, it is oxidized at a temperature above 370° C., whereby the lubricating effect decreases remarkably. Furthermore, it is also locally produced as a natural resource and is relatively high in the cost.

Graphite is fairly widely used owing to the relatively low cost, but is susceptible to the influence of the atmosphere. That is, when graphite is used in the ambient atmosphere or an oxidizing atmosphere, it is oxidized at about 550° C. to lose its effect. Furthermore, graphite is apt to burn and is in danger of causing a fire or the like because it consists only of carbon (including small amount of silica and the like as impurities).

Lately, PTFE is of interest owing to the good lubricity but is restricted in use because it is poor in thermal resistance (decomposition at about 350° C.) and is very expensive. The other solid lubricants have merits and demerits in their performances and are hardly used at present except for specific applications.

As mentioned above, in terms of performance and economy the conventionally used molybdenum disulfide, graphite and PTFE are not satisfactory.

The lubricant composition according to the invention is superior to molybdenum disulfide or the like as a lubricant. The calcium ferrites, which are a main ingredient of the composition of the invention, have the following features as compared with molybdenum disulfide or the like:

(1) These ferrites are never fused even at an elevated temperature above 1,000° C. (The melting point of each ferrite depends on the composition, but is within a range of 1,200° C. to 1,450° C.);

(2) Each ferrite is constructed with a combination of oxides, so that no oxidation is caused;

(3) There is no problem of natural resources such as uneven distribution, depletion or the like; and (4) The ferrites are composed of iron, calcium and oxygen, which do not endanger living organisms so that the safety is high.

These features are advantageous for using the composition according to the invention as a lubricant, and show that such a composition can be used even in applications (e.g. higher temperature, oxidizing atmosphere and the like), in which the conventionally used molybdenum disulfide or the like has never been applicable.

According to the invention, there are used any or all of the following three calcium ferrites:

(1) monocalcium ferrite: $CaFe_2O_4$ (=$CaO.Fe_2O_3$)
(2) dicalcium ferrite: $Ca_2Fe_2O_5$ (=$2CaO.Fe_2O_3$)
(3) hemicalcium ferrite: $CaFe_4O_7$ (=$CaO.2Fe_2O_3$).

As a result of various studies, it has been confirmed that dicalcium ferrite is superior as to lubricity to the other two ferrites capable of sufficiently achieving the object of the invention.

In the production of these calcium ferrites, a calcium ferrite of a single composition or a mixture of calcium ferrites having an optional mixing ratio can be obtained by properly selecting a molar ratio of iron oxide to calcium compound. According to the invention, it is not always necessary to have a single composition. An important feature of the invention is the purity of the calcium ferrites in the lubricant composition; that is, it is necessary that the purity of the ferrites as a main ingredient in the composition be not less than 60% by weight, preferably not less than 80% by weight, more particularly not less than 95% by weight. Moreover, there will tend to be various iron oxides and calcium oxide, which are unreacted substances in the production of the ferrites, and silica, alumina and the like contained in the starting materials as impurities. Among these impurities, calcium oxide has little influence, while ferric oxide, silica and alumina adversely affect the lubricity owing to their high hardness and abrasive action, so that it is desirable to exclude the latter substances as far as possible. In this connection, it is preferred that the amount of the impurities be not more than 20% by weight, preferably not more than 5% by weight.

Accordingly, it is desirable to use as the starting materials iron oxides and calcium compounds each having as low a content as possible of impurities such as silica, alumina and the like. Furthermore, it is preferred to produce the calcium ferrites so as to reduce the remaining free ferric oxide as far as possible. Specifically, it is better to use the calcium compound in a quantity somewhat larger than the theoretical quantity.

Ferric oxide is mixed with a calcium compound selected from quick lime (calcium oxide), slaked lime (calcium hydroxide), calcium carbonate and the like in a molar ratio of ferric oxide to the calcium compound of 1:0.5–1:2 and the resulting mixture is fused by heating (1,200°–1,400° C., maintained at this temperature for several hours and then cooled.

When the calcium ferrites produced by the above method are used in the lubricant composition according to the invention, they are first pulverized by a grinding machine such as a ball mill, jet mill or the like and in this case, the particle size is to be not more than 100 μm, preferably 0.1–5 μm. When the particle size exceeds 100 μm, the adhesion of particles to a lubricating area is weak, while when the particle size is smaller than 0.1 μm, conspicuous improvement of the lubricity is not observed and the increase of the pulverizing cost becomes higher. The particle size is preferably 0.1–5 μm with regard to dispersibility, lubricity, economy, etc.

According to the invention, the calcium ferrites produced as mentioned above are used as a solid lubricant as they are or by dispersing in a base oil such as a lubricating oil, grease and the like or a binder such as a resin. In the former case, the thermal resistance is excellent, but the feeding to a lubricating area is somewhat troublesome. In the latter case, the feeding is easy and practical, but the thermal resistance is restricted by the nature of the base oil or binder and is inferior to the former case. Therefore, it is preferable to properly select the method of applying the calcium ferrites in accordance with the application involved.

When the calcium ferrites are used by incorporating and dispersing into the base oil such as a lubricating oil, grease and the like, it is necessary that not less than 0.1% by weight, preferably not less than 1% by weight of these ferrites is contained in the lubricant composition. When the content of the ferrites is less than 0.1% by weight, the improvement of lubricating performance is very little and impractical. On the other hand, when the content of the ferrites is not less than 1% by weight inclusive of 100% by weight, the resulting lubricant composition may properly be used in compliance with the application involved.

The base oil to be used in the invention can be any of the conventionally used lubricants, for example mineral oils; various animal and vegetable fats and oils; synthetic lubricating oils such as ester oil, silicone oil, fluorine oil and the like; waxes such as paraffin wax, microcrystalline wax, ester wax and the like; and fabricated lubricants such as lubricating grease, lubricating compounds and the like.

The binders to be used in the invention include alkyd resins, acrylic resins, melamine resins, urethane resins and the like. When using such a binder, at least one calcium ferrite is incorporated into the binder and then applied to a lubricating area to form a coating film.

The surfaces of the calcium ferrite particles may be subjected to a physical or chemical treatment by any well-known method in order to facilitate their dispersing into the lubricating oil, grease, resin or the like.

If necessary, additives such as an antioxidant, rust inhibitor, corrosion inhibitor, dispersant, oiliness agent and the like may be added to the lubricant composition according to the invention. Furthermore, the lubricant composition may be economically and advantageously mixed with other solid lubricants (molybdenum disulfide, graphite, PTFE and the like) without degrading the lubricating performance.

Although the reason why the lubricant composition according to the invention is excellent as a lubricant is not fully known, it may be as follows:

(1) The lubricant composition is easily absorbed on lubricating surfaces because the chemical compositions of the calcium ferrites are similar to the states of lubricating surfaces where oxide film exists.
(2) The calcium ferrites are easily crushed by external force.

The following examples are given in illustration of the invention and are not intended as limitations thereof.

EXAMPLE 1

(1) Production of calcium ferrite 56 g of ferric oxide (average particle size: 3 μm) and 52 g of calcium hydroxide (average particle size: 3 μm) were weighed into a porcelain crucible and thoroughly mixed therein, which was placed into an electric furnace and heated at 1,200° C. for 5 hours. After the cooling, the resulting mass was taken out from the crucible and pulverized by a ball mill to obtain a dark brown, dry powder having an average particle size of 3 μm. This powder was seen to contain more than 95% by weight of dicalcium ferrite ($Ca_2Fe_2O_5$) by the X-ray diffractometry.

(2) Evaluation of lubricity

The calcium ferrite powder produced above (1) was added to a mineral oil (viscosity: 200 cSt at 37.8° C.) at concentrations of 0.5% by weight, 2.5% by weight, 5.0% by weight, 20.0% by weight and 50.0% by weight and uniformly dispersed therein by means of a colloid mill. The lubricity was examined with respect to the resulting dispersion as well as that of molybdenum disulfide having an average particle size of 3 μm by a Falex lubricant tester (according to ASTM D-3233B method) to obtain the results as shown in the following Table 1.

TABLE 1

| Sample | Example 1 | | | | | Molybdenum disulfide | | | | | Mineral Oil (base oil) |
|---|---|---|---|---|---|---|---|---|---|---|---|
| Concentration (% by weight) | 0.5 | 2.5 | 5.0 | 20.0 | 50.0 | 0.5 | 2.5 | 5.0 | 20.0 | 50.0 | |
| Seizuring load | | | | | | | | | | | |
| lbf | 1,500 | 3,500 | 4,250 | 4,500+ | 4,500+ | 1,000 | 1,500 | 2,000 | 2,750 | 3,000 | 500 |
| (kgf) | (681) | (1,589) | (1,930) | (2,043+) | (2,043+) | (454) | (681) | (908) | (1,249) | (1,362) | (227) |

EXAMPLE 2

(1) Production of calcium ferrite

The same procedure as described in Example 1 was repeated.

(2) Evaluation of lubricity

The calcium ferrite powder produced above (1) was added in an amount of 20.0% by weight to a lithium grease No. 2 (base oil: mineral oil having a viscosity of 12.8 cSt at 98.9° C.) as a base grease and was thoroughly dispersed therein by a three roll mill. The lubricity was examined with respect to the resulting dispersion as well as that of molybdenum disulfide having an average particle size of 3 μm by the same method as described in Example 1 to obtain the results as shown in the following Table 2.

TABLE 2

| Sample | Example 2 | Molybdenum disulfide | Base grease |
|---|---|---|---|
| Seizuring load | | | |
| lbf | 2,250 | 1,750 | 500 |
| (kgf) | (1,022) | (795) | (227) |

EXAMPLES 3 THROUGH 6

Various calcium ferrites were produced by using the same starting materials as in Example 1 and varying the molar ratio of the starting materials to be mixed. The production methods were the same as described in Example 1.

The resulting calcium ferrite was added in an amount of 20% by weight to a mineral oil (viscosity: 200 cSt at 37.8° C.) and dispersed therein by a colloid mill, which was evaluated with respect to lubricity by the same method as described in Example 1.

In the following Table 3 are shown the molar ratios of the starting materials, resulting calcium ferrites and test results for lubricity.

TABLE 3

| | Molar ratio of $Fe_2O_3/Ca(OH)_2$ | Calcium ferrites produced (% by weight*) $Ca_2Fe_2O_5$ | $CaFe_2O_4$ | $CaFe_4O_7$ | Others | Seizuring load lbf | (kgf) |
|---|---|---|---|---|---|---|---|
| Example 3 | 1/1 | 5 | 85 | 5 | 5 | 4,500 | (2,043) |
| Example 4 | 2/1 | ≅0 | 5 | 90 | 5 | 4,250 | (1,930) |
| Example 5 | 1/1.5 | 65 | 35 | ≅0 | ≅0 | 4,500+ | (2,043+) |
| Example 6 | 1.5/1 | ≅0 | 30 | 65 | 5 | 4,250 | (1,930) |
| Molybdenum disulfide (average particle size: 3 μm) | | | | | | 2,750 | (1,249) |

*Measurement of less than 5% is impossible by the X-ray diffraction quantitative method.

EXAMPLES 7 THROUGH 11

Various calcium compounds were used to produce calcium ferrites at the same molar ratio of ferric oxide to calcium compound as in Example 1. The production method was the same as described in Example 1. All of the resulting calcium ferrites were found to contain more than 95% of dicalcium ferrite and were evaluated with respect to lubricating performance as in Examples 3 through 6.

In the following Table 4 are shown the calcium compounds used and test results for lubricity.

TABLE 4

| | Calcium compound used (average particle size) | Seizuring load lbf | (kgf) |
|---|---|---|---|
| Example 7 | Calcium carbonate (3 μm) | 4,500+ | (2,043+) |
| Example 8 | Calcium carbonate (0.07 μm) | 4,500+ | (2,043+) |
| Example 9 | Calcium carbide (3 μm) | 4,500+ | (2,043+) |
| Example 10 | Calcium oxalate (3 μm) | 4,500+ | (2,043+) |
| Example 11 | Calcium acetate dihydrate (needle crystal) | 4,500+ | (2,043+) |

EXAMPLE 12

The lubricating performance of the calcium ferrite produced in Example 1 (dicalcium ferrite) was evaluated by a four-ball extreme-pressure lubricant tester.

In this test, after four balls were set in a ball pot, the powder was thoroughly filled to the ball pot and then the weld load was measured. The weld load was 500 kgf.

EXAMPLE 13

The calcium ferrite produced in Example 1 (dicalcium ferrite) was dispersed in a mineral oil in an amount of 20% by weight and then the resulting dispersion was evaluated with respect to lubricating performance at high temperature by means of a high temperature sliding lubrication tester to obtain the results as shown in following Table 5.

TABLE 5

(Test Temperature: 1,000° C.)

| Sample | Example 13 | Molybdenum disulfide (average particle size: 3μ) | Mineral oil (base oil) |
|---|---|---|---|
| Seizuring time (second) | 29 | 9 | 4 |
| Friction coefficient μ (just before seizuring) | 0.11 | 0.10 | 0.23 |

Outline of the test

A friction coefficient was obtained when a fixed test piece heated to a predetermined temperature was put between upper and lower rotating rolls under a predetermined load feeding a lubricant to the pinch side. The durability of the lubricant film was then examined without feeding the lubricant. The lubricating performance of the lubricant was evaluated by the friction coefficient and the durability of the lubricant film. The friction coefficient was calculated by the following equation:

$$\mu = T/R \cdot W$$

wherein T is torque, R is a radius of a roll, and W is a load.

Specification of the tester

| Type | Peripheral speed of roll | Roll size | Material of roll | Roll hardness |
|---|---|---|---|---|
| High temperature sliding lubrication tester | 7.8–78 mpm | 80 × 120 ϕ | Adamite | $H_s50$ |

-continued

| Type | Peripheral speed of roll | Roll size | Material of roll | Roll hardness |
|---|---|---|---|---|
| tester | | | | |

Test method

The sample held at 50° C. was uniformly sprayed on the rotating roll surface from the test piece pinching side by means of an air atomize-type oiling apparatus. The lower roll was raised by a hydraulic system so that the test piece was loaded at 1 ton. The feeding of the sample was continued for 10 seconds at this load and then stopped. At once, a timer was started and the rolls were again rotated at the load until seizure (judging from abnormal change of torque) occurred. Furthermore, the friction coefficient just before seizure was determined by calculation.

Testing conditions

| Load | Peripheral speed of roll | Temperature of test piece | Surface roughness of roll | Roll temperature | Material of test piece | Surface roughness of test piece | Width and thickness of test piece | Oiling quantity |
|---|---|---|---|---|---|---|---|---|
| 1 ton | 60 mpm | 1,000° C. | 0.2 μm | 130° C. | SS-41 | 0.5 μ | 20 × 18 mm | 5 ml/min |

From the above examples, it is apparent that the lubricant composition according to the invention is a lubricant suitable for use over a very wide range.

What is claimed is:

1. A lubricant composition comprising not less than 0.1% by weight of at least one calcium ferrite selected from the group consisting of monocalcium ferrite, dicalcium ferrite and hemicalcium ferrite, which is produced by mixing an iron oxide and a calcium compound in a molar ratio of 1:0.5 to 1:2 and fusing them by heating at a temperature of 1200°–1400° C. and contains not more than 5% by weight in total of ferric oxide, silica and alumina as an impurity in admixture with a mineral oil.

2. A lubricant composition according to claim 1, wherein said calcium ferrites have an average particle size of not more than 100μ.

3. A lubricant composition according to claim 1, wherein said calcium ferrites have an average particle size of 0.1 to 5μ.

4. A lubricant composition according to claim 1, wherein said mineral oil has a viscosity of about 200 cSt at 37.8° C.

5. A lubricant composition according to claim 1, wherein said amount is not less than 1% by weight.

6. A lubricant composition according to claim 4, wherein said mineral oil is incorporated in a lubricating grease.

* * * * *